United States Patent [19]

Timmerman

[11] 3,945,639

[45] Mar. 23, 1976

[54] GAME TABLE

[76] Inventor: William O. Timmerman, 274 Belle Vernon Court, Rochester, Mich. 48063

[22] Filed: Mar. 17, 1975

[21] Appl. No.: 558,837

[52] U.S. Cl. ..... 273/3 A
[51] Int. Cl.[2] ..... A63D 15/00
[58] Field of Search ..... 273/3 R, 3 A, 12, 123, 273/125; D34/3

[56] References Cited

UNITED STATES PATENTS

| | | | |
|---|---|---|---|
| 685,596 | 10/1901 | Genter et al. | 273/125 R |
| 735,132 | 8/1903 | McCutchen, Jr. | 273/123 R X |
| 918,799 | 4/1909 | Uhrland | 273/123 R X |
| D83,102 | 1/1931 | Goddard | 273/3 A UX |

*Primary Examiner*—Paul E. Shapiro
*Attorney, Agent, or Firm*—Dressler, Goldsmith, Clement & Gordon, Ltd.

[57] ABSTRACT

A game table with a playing surface and cushion rail assembly surrounding the playing surface is disclosed herein. The playing surface has a plurality of lateral edges at least two of which merge to produce a right-angle corner which is adapted to fit in the corner of a room. A plurality of pockets are located on the periphery of the surface opposite the right-angle corner while the right-angle corner is devoid of any pockets.

14 Claims, 4 Drawing Figures

GAME TABLE

BACKGROUND OF THE INVENTION

The present invention relates generally to gaming tables and, more particularly to tables that are utilized for playing pocket pool.

The game of pocket pool has been in existence for many years. A conventional table for playing pocket pool consists of a rectangular structure that has pockets at each of the corners and two additional pockets along the railing of two of the opposed sides.

In recent years, pool tables have become increasingly more popular for use in recreation rooms or family rooms of private homes. One of the problems of a conventional rectangular table, which is normally 4 feet by 8 feet in dimension, is the amount of space that is required to allow sufficient space to compensate for the length of the cue sticks that are normally used in playing the game. It has been found that at least 4 feet of space is required around the entire table to insure that a shot can be made from any angle at any given position of the table.

Thus, in order to provide an adequate clearance around the table at least 200 square feet of floor space is required for the conventional table, which is normally the major part of a recreation room in a private home.

Various alternates have been proposed as substitutes for the conventional pool table, such as tables utilized in the game of bumper pool. Other alternates for the conventional pool table are disclosed in U.S. Pat. Nos. 2,923,546; 3,463,489; 3,488,054; and 3,700,235. While these patents disclose tables in various size, shape and form, all have the same problem of requiring a substantial amount of space surrounding the table in order to properly play the game.

SUMMARY OF THE INVENTION

According to the present invention, a new table has been developed which is capable of being placed in the corner of a recreation room to substantially reduce the amount of space required while still allowing for playing a pool game.

The gaming table of the present invention consists of a playing surface on a frame with a cushion rail assembly surrounding and extending above the playing surface. The playing surface has a plurality of corners, at least one of which is right-angled to be placed in the corner of a room space. The playing surface has a plurality of pockets at the periphery thereof with at least two of the pockets being located in adjacent corners of the playing surface and the right-angled corner of the playing surface being devoid of a pocket.

In its preferred embodiment, the gaming table is square in configuration and has pockets located in three of the four corners with the fourth corner, which has no pocket, being adapted to fit into the corner of a room space. The table can also be rectangular with two of the corners being devoid of pockets or have five sides with three of five sides intersecting at oblique angles.

DETAILED DESCRIPTION

Figure 1:
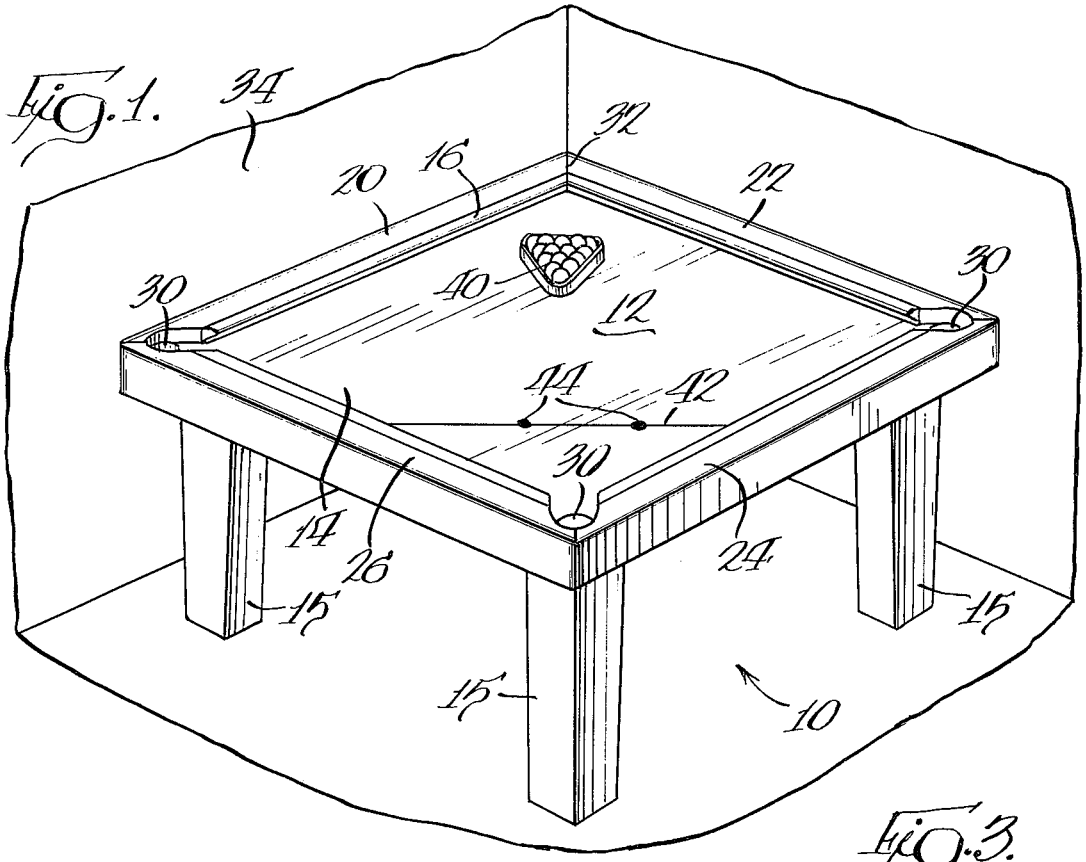
FIG. 1 shows a perspective view of the gaming table of the present invention in a preferred position within a room.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

Figure 2:
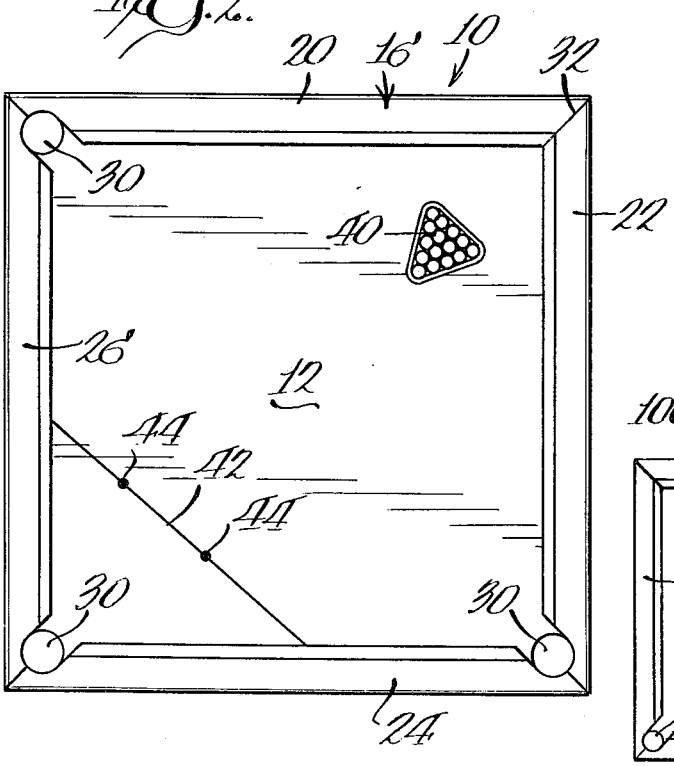
FIG. 2 is a plan view of the table shown in FIG. 1.

The preferred form of game table is disclosed in FIGS. 1 and 2 and is generally designated by the reference numeral 10. Table 10 has a flat playing surface 12 defined on a frame 14 which is supported by legs 15. In the embodiment illustrated in FIGS. 1 and 2, playing surface 12 is square and has a cushion rail assembly 16 surrounding and extending above the surface. The cushion rail assembly 16 is conventional in nature and no detailed description thereof appears to be necessary.

As seen in FIG. 2, cushion rail assembly has four sides 20, 22, 24, 26. Each pair of adjacent sides of cushion rail assembly 16 intersect at right angles to each other to produce four corners on the playing surface. As most clearly shown in FIG. 2, only three of the four corners have ball receiving pockets 30. The fourth corner 32, between adjacent sides 20 and 22 is devoid of any pocket and is designed to fit in the corner of a room space 34 as illustrated in FIG. 1.

Table 10 constructed in accordance with the teachings of the present invention, is designed to have the balls 40 racked in a group adjacent corner 32 which is devoid of a pocket. All of the shots made during the game are made from an area adjacent the corner which is opposite corner 32. This may be done by producing a line 42 extending diagonally across the table adjacent the corner. Alternatively, two spots 44 may be placed at selected locations adjacent the corner opposite corner 32. With two players, one player would make all of the shots from one of the spots while the second player would make all of his shots from the other spot.

As will be appreciated, with the construction of the table as described above, most all of the shots made during a game require that the ball must first hit one of the cushion rail sides and banked towards a pocket or ball-receiving receptacle.

Figure 3:
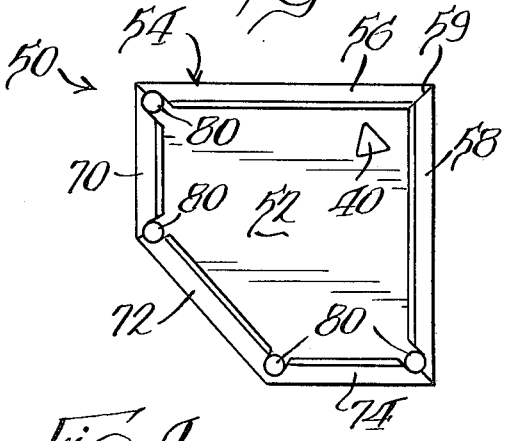
FIG. 3 is a plan view of a modified configuration of the table shown in FIG. 2.

An alternate embodiment of the invention is illustrated in FIG. 3, wherein table 50 has a polygonal playing surface 52 with five sides. Rail assembly 54 has two sides 56 and 58 which merge at right angles to each other and corner 59 produced between the two adjacent sides 56 and 58 is devoid of a pocket. The portion of the rail assembly or framework which is opposite to the corner between sides 56 and 58 has three intersecting sides 70, 72 and 74, all of which intersect at oblique angles and four pockets 80 are located at the intersection of the respective side. The table illustrated in FIG. 3 is again designed so that corner 59, which is devoid of a pocket, to be located in the corner of a room space.

When playing with a table such as table 50 illustrated in FIG. 3, balls 40 would be racked adjacent corner 59 and all of the shots would be made from an area adjacent side 72.

Figure 4:
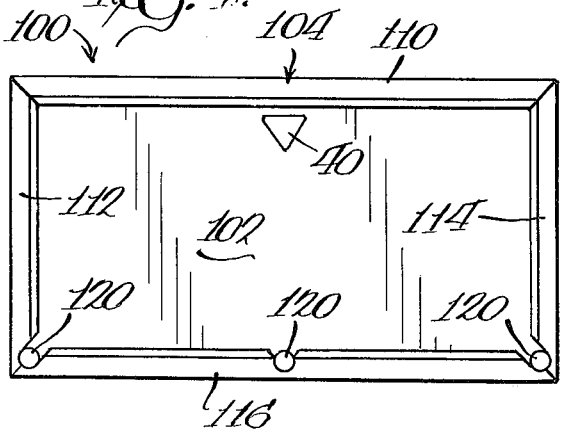
FIG. 4 is a further modified configuration of the gaming table of the present invention.

A further modified form of the invention is shown in FIG. 4 wherein table 100 has a rectangular playing surface 102 with cushion rail assembly 104 having four sides 110, 112, 114 and 116 all of which intersect at right angles to each other. In the embodiment illustrated in FIG. 4, the table has three pockets which are all located on side 116 with two of the pockets being at the respective corners defined at opposite ends of side 116 and the third pocket being equally spaced from opposite ends of side 116.

In the embodiment illustrated in FIG. 4, the balls 40 would be racked adjacent or against rail or side 104 and all of the shots would be taken from an area adjacent side 116.

As can be appreciated from the above description, the present invention provides a unique game table which can be placed in a small area of a room requiring considerably less space than tables that have previously been used. Furthermore, with the size and location of the table described above, the table could readily be converted for many other uses. For example, a suitable table top type of cover could be designed to be placed over the playing surface and the table could then be used for other purposes, such as poker, chess or checkers.

Another modification is that the table can be attached to one of the walls defining room space 34 by hinges (not shown) and the legs can be pivotally supported or removable so that the table can be positioned vertically, i.e. against one of the walls, for storage purposes. With this version of the invention, the leg structure consists of an enlarged panel extending downwardly from side 26 and secured to the lower surface of frame 14 by hinges. The surface of the panel can then be utilized for other games, such as darts, when the table 10 is in the storage position.

A further modification to the embodiment shown in FIGS. 1 and 2 is to substitute an arcuate side for the sides 24 and 26 opposite corner 32 and to have a plurality of pockets or ball-receiving receptacles along the arcuate side.

What I claim is:

1. A pool table comprising, a frame, a horizontal playing surface on said frame, said playing surface having a plurality of corners, an upstanding rail assembly bordering said playing surface above the level thereof, and a plurality of pockets on said playing surface at the periphery thereof, at least two of said pockets being at adjacent corners of said playing surface and at least one other corner of said playing surface being devoid of a pocket, said pockets being one less in number than said corners.

2. A pool table as defined in claim 1, in which said playing surface is rectangular and has three pockets.

3. A pool table as defined in claim 2, in which said three pockets are respectively located in three adjacent corners of said playing surface.

4. A pool table as defined in claim 3, in combination with a housing space having at least two vertical walls intersecting at substantially right angles to each other and in which said corner devoid of a pocket is located at the intersection of said walls.

5. A pool table as defined in claim 2, in which said third pocket is located between said at least two of said pockets.

6. A pool table as defined in claim 1, in which all of said pockets are located in respective corners of said playing surface.

7. A pool table as defined in claim 1, in which said playing surface is rectangular.

8. A pool table as defined in claim 7, in which a third of said pockets is located along said periphery intermediate said adjacent corners.

9. A pool table as defined in claim 1, in which said playing surface has more than four edges and at least two edges merging with each other at substantially right angles to each other and in which said corner defined at the merger of said at least two edges is devoid of a pocket.

10. A game table comprising a frame having a rectangular playing surface with four peripheral lateral edges and adjacent edges merging with each other to define corners for said playing surface, a cushion rail surrounding said playing surface above said frame, and three ball-receiving receptacles for said playing surface, said three ball-receiving receptacles being respectively located in adjacent corners of said playing surface and said fourth corner and said lateral edges being devoid of pockets and said fourth corner being adapted to be received into the corner of a room space.

11. In combination, a housing structure having at least two intersecting vertical walls defining a corner space; and a game table comprising a frame, means supporting said frame within said corner space and closely adjacent said walls, a horizontal playing surface supported by said frame and occupying said corner space, an upstanding rail structure enclosing said playing surface around the periphery thereof and extending above the upper surface level thereof, said rail structure having an accessible rail portion outwardly facing from said corner space and reaching across from one said wall to the other, a plurality of spaced ball-receiving openings provided in said playing surface adjacent said accessible outwardly facing rail portion, the opposite portion of said playing surface, located inwardly within said corner, being characterized by the absence of any such ball-receiving openings.

12. The combination according to claim 11, wherein said outwardly facing portion of the rail structure is composed of between two and three segments defining between three and four corners, including the intersections at said walls, and wherein said ball-receiving openings are provided adjacent the locations of at least three of said corners.

13. The combination according to claim 11, wherein said outwardly facing portion of the rail structure has three obliquely intersecting sides and four ball-receiving openings at their intersecting locations.

14. The combination according to claim 11, in which said outwardly facing portion of the rail structure has two sides intersecting at right angles to each other and three corner ball-receiving openings in said playing surface.

* * * * *